US007284732B1

(12) United States Patent
Lopa

(10) Patent No.: US 7,284,732 B1
(45) Date of Patent: Oct. 23, 2007

(54) NON LIFT BAG HOLDER FRAME

(76) Inventor: Vito Lopa, 38 Bennett Pl., Staten Island, NY (US) 10312

( * ) Notice: Subject to any disclaimer, the term of this patent is extended or adjusted under 35 U.S.C. 154(b) by 49 days.

(21) Appl. No.: 11/232,157

(22) Filed: Sep. 21, 2005

(51) Int. Cl.
*B65B 67/04* (2006.01)

(52) U.S. Cl. ..... 248/99; 248/101

(58) Field of Classification Search ..... 248/95, 248/97, 99, 100
See application file for complete search history.

(56) References Cited

U.S. PATENT DOCUMENTS

| | | | | | |
|---|---|---|---|---|---|
| 261,458 | A | | 7/1882 | Holekamp | |
| 1,005,956 | A | | 10/1911 | Gibbons | |
| 2,117,689 | A | | 5/1938 | Tatsch | |
| 3,771,752 | A | | 11/1973 | Meeh | |
| 4,157,801 | A | * | 6/1979 | Elmer | 248/97 |
| 4,174,085 | A | | 11/1979 | Ferreira et al. | |
| 4,273,167 | A | | 6/1981 | Stillwell | |
| 4,667,912 | A | | 5/1987 | DeVilbiss | |
| 4,735,340 | A | * | 4/1988 | Preston | 220/495.1 |
| 4,899,967 | A | * | 2/1990 | Johnson | 248/97 |
| RE33,842 | E | * | 3/1992 | Ebentheuer | 248/97 |
| 5,427,340 | A | | 6/1995 | Stromsmoe et al. | |
| 5,735,495 | A | * | 4/1998 | Kubota | 248/100 |
| 6,199,802 | B1 | * | 3/2001 | Scheibe, Sr. | 248/97 |
| 6,267,334 | B1 | | 7/2001 | Siu | |
| 6,293,505 | B1 | | 9/2001 | Fan | |
| 6,676,092 | B2 | * | 1/2004 | Tsai | 248/97 |
| 6,920,834 | B1 | * | 7/2005 | Pehta et al. | 108/147.21 |

FOREIGN PATENT DOCUMENTS

| | | | | |
|---|---|---|---|---|
| CA | 2409401 | | 5/2004 | |
| GB | 2177996 | * | 2/1987 | 248/97 |
| WO | WO03/106293 | | 12/2003 | |

* cited by examiner

*Primary Examiner*—Ramon O Ramirez
(74) *Attorney, Agent, or Firm*—Michael I Kroll

(57) ABSTRACT

Apparatus 10 discloses a freestanding frame 16 providing means for mounting a garbage bag 12 therein. The freestanding frame 16 has a relatively conic-like shape in cross section with the top orifice 18 smaller than the bottom orifice 20. Extending between the top and bottom members are a number of struts 22, which may be telescopic, completing the frame 16 that provides means for removing the frame from a full refuse bag 12 as opposed to lifting the bag from the frame. Additionally the apparatus incorporates means 24 for selectively fastening the plastic bag to or about the top of the frame 16. In the preferred embodiment, the shape of the rim for the top 18 and bottom 20 is circular, which affords the largest possible area with the least amount of material but does not exclude the use of polygonal shapes.

7 Claims, 12 Drawing Sheets

STEP 1

INSTALL EMPTY BAG, FASTEN OPEN TOP OF BAG USING RETAINING CLIPS. BAG IS READY TO USE.

STEP 2

WHEN BAG IS FULL REMOVE THE RETAINING CLIPS. TIE CLOSED THE TOP OF THE BAG WITH A BAG TIE.

STEP 3

TO REMOVE BAG; LIFT UNIT UP OVER FULL GARBAGE BAG. GARBAGE BAG REMAINS RESTING ON GROUND.

GARBAGE BAG IS NOW SEPARATE FROM EASY FRAME.

NON LIFT BAG HOLDER FRAME

BACKGROUND OF THE INVENTION

1. Field of the Invention

The present invention relates generally to receptacles and, more specifically, to a freestanding frame providing means for mounting a garbage bag therein. The freestanding frame has a relatively conic-like shape in cross section with the top orifice smaller than the bottom orifice. Extending between the top and bottom members are a number of struts, which may be telescopic, completing the frame that provides means for removing the frame from a full refuse bag as opposed to lifting the bag from the frame.

Additionally the present invention incorporates means for selectively fastening the plastic bag to or about the top of the frame providing a maw diametrically increasing in area to the foundation.

Preferably, the frame is constructed to be lightweight, since the frame will be moved instead of the bag. The actual materials used in its construction can be wood, metal, plastic or composite thereof in rod or tube-like shape.

Furthermore, in the preferred embodiment, the shape of the rim for the top and bottom is circular, which affords the largest possible area with the least amount of material but does not exclude the use of polygonal shapes. Nor are the members excluded from comprising a number of elements having fittings for erecting the freestanding frame. The obvious advantage being that the stored footprint may be smaller than the assembled footprint.

2. Description of the Prior Art

There are other frame devices designed for bags. Typical of these is U.S. Pat. No. 261,458 issued to Holekamp on Jul. 18, 1882.

Another patent was issued to Gibbins on Oct. 17, 1911 as U.S. Pat. No. 1,005,956. Yet another U.S. Pat. No. 2,117,689 was issued to Tatsch on May 17, 1938 and still yet another was issued on Nov. 13, 1973 to Meeh as U.S. Pat. No. 3,771,752.

Another patent was issued to Ferreira et al. on Nov. 13, 1979 as U.S. Pat. No. 4,174,085. Yet another U.S. Pat. No. 4,273,167 was issued to Stillwell on Jun. 16, 1981. Another was issued to DeVilbiss on May 26, 1987 as U.S. Pat. No. 4,667,912 and still yet another was issued on Jun. 27, 1995 to Stromsmoe et al. as U.S. Pat. No. 5,427,340.

Another patent was issued to Siu on Jul. 31, 2001 as U.S. Pat. No. 6,267,334. Yet another U.S. Pat. No. 6,293,505 was issued to Fan on Sep. 25, 2001. Another was published to Sidor on Dec. 23, 2003 as International Patent Application No. W003/106293 and still yet another was issued on May 13, 2004 to Callahan et al as Canadian Patent No. CA2409401.

U.S. Pat. No. 261,458

Inventor: Julius Holekamp

Issued: Jul. 18, 1882

The combination, with the vertical standards B, radially adjustable, as set forth, of the vertically-adjustable hooks C and adjustable ring D, substantially as described.

U.S. Pat. No. 1,005,956

Inventor: Frank Gibbins

Issued: Oct. 17, 1911

In a bag holder of the character described, the combination of a frame open laterally and comprising an upper and a lower hemispherical hoop held in parallel planes by a plurality of standards having extended portions bent to form feet, certain of said standards provided with rigidly mounted hooks adapted to hold open the month of a bag and certain of said standards provided with inwardly bent portions having recesses, pivotally mounted latches in said recesses having hook portions with handles, whereby a bag held in suspended position by said pivotally mounted hooks, may be released, substantially as described.

U.S. Pat. No. 2.117,689

Inventor: Otto A. Tatsch

Issued: May 17, 1938

A bag holder comprising a wire stand having a base to accommodate a paper bag, an upright attached to and rising from the base, said upright being of general U-shaped form to permit it to be suspended from a nail or the like, and a manually-regulated and adjustable bag-grip slidable on said upright, the legs of said upright being in pressure contacting engagement with the bag grip for securing the bag grip in predetermined positions thereon.

U.S. Pat. No. 3,771,752

Inventor: Robert F. Meeh

Issued: Nov. 13, 1973

A refuse bag holder comprising a base formed of intersecting members, selectedly extensible legs extending upwardly from said base for converging at their upper ends and a support ring secured to the upper ends of said legs. Clasp members are provided on said legs for engaging portions of the bag to be filled. Said support ring is formed of a plurality of components adapted for mutual contraction and expansion for accommodating bags of varying diameter. The components of holder A are designed for assembly and disassembly.

U.S. Pat. No. 4,174,085

Inventor: Richard A. Ferreira

Issued: Nov. 13, 1979

A trash bag holder which moves from a generally planar collapsed storage position automatically to an open use position in which it can be used to support a flexible wall container such as a plastic trash bag. The device includes a substantially rigid rectangular frame from which elongated support elements outwardly extend at each corner thereof. The corners are each provided with a tapered socket to receive one end of such support elements which are, in turn, connected thereto by means of an extensible cord. The support elements may thus be moved to a collapsed position generally parallel to adjacent frame elements wherein the cords are under tension and when released, will automatically move to their extended open position for receipt of a trash bag.

U.S. Pat. No. 4,273,167

Inventor: David J. Stillwell

Issued: Jun. 16, 1981

A trash bag holding stand that may be manually assembled without the use of tools to support a pliable bag (such as a plastic bag) in open fillable position. The stand includes a rectangular frame with its corners formed of right angle pipe elbows having sockets disposed at right angles to each other. The sides of the frame are elongated members such as pipes which are telescoped into the respective sockets of the elbows to form the frame. The elbows also have leg-receiving sockets into which legs are telescoped to support the frame. Upstanding pins are disposed on the top surface of the elbows for detachably receiving the plastic bag. The stand may be provided with a cloth bag for receiving the plastic bag to protect it from breaking. A funnel may be provided to facilitate flow of waste material into the plastic bag.

U.S. Pat. No. 4,667,912

Inventor: Charles E. DeVilbiss

Issued: May 26, 1987

A collapsible wire form support or rack for flexible plastic bags consisting of two main vertical inverted "U" shaped supports interconnected at their bases by parallel rods, that collapses by rotating one support about a vertical axis relative to the other until both supports and rods are substantially coplanar.

U.S. Pat. No. 5,427,340

Inventor: Mylo Stromsmoe

Issued: Jun. 27, 1995

There is described an improved apparatus for holding a liner or bag in an open condition, comprising a ground-engaging base and opposed frames adapted to extend upwardly from the base for supporting the liner therefrom, the frames being sufficiently spaced apart that attachment of the liner causes biasing of liner engaging portions of the frames against the liner for tensioning it into an open condition.

U.S. Pat. No. 6,267,334

Inventor: Victor Wai Park Siu

Issued: Jul. 31, 2001

Existing free-standing bag holders are of fixed width exist, both with and without wheels, for supporting plastic garbage bags, recycling bags etc. However, bag holders of fixed width are not useful for all bags. The present invention provides a bag holder which is adjustable to support large, flexible bags of various widths by adjusting the spacing of vertical support members on a base member.

U.S. Pat. No. 6,293,505

Inventor: Jianhua Fan

Issued: Sep. 25, 2001

A bagger apparatus includes a platform having an opening proximate a center of the platform and a bag holder being retained by the platform proximate the opening of the platform. In use, a bag having an opening is held by the bag holder. The opening of the bag is aligned to the opening of the platform. The platform has a wider area than the opening of the bag such that an object received by the platform can be led to the bag via the opening of the platform and the opening of the bag.

International Patent Application Number WO 03/106293

Inventor: Richard J. Sidor et al.

Issued: Dec. 24, 2003

The present invention provides a waste disposal apparatus with an extensible connection for integration into a piece of furniture.

Canadian Patent Number CA2409401

Inventor: Tom Callahan

Issued: May 13, 2004

A device or Ring designed for the purpose of holding or suspending garbage bags in the air by placing a garbage ring bag on a garbage tree hook or any other similar device. This device is designed so that when the rings are attached or secured to the garbage bag, the garbage bag rings can easily be placed and hung on the hooks provided from the garbage tree as depicted in drawings 12,13,14. This garbage bag ring is placed or located in the upper opening part of the garbage bag as shown in drawings 8,9,10,11. The ringlets or rings of the garbage bag may be made of plastic, cardboard, metal or composite depending on durability and cost consideration. Also, rings or the bag support holds may vary in geometric shapes and sizes also types like non-slip type etc. as depicted in drawings 3,4,5,6,7. When garbage bag rings are placed or set in the garbage bag the material or plastic surrounding the outer part from the ring maybe reinforce with extra material to give the hanging rings more staying or holding power as shown in drawings 5,6,7,8,9,10,11.

While these bag frame devices may be suitable for the purposes for which they were designed, they would not be as suitable for the purposes of the present invention, as hereinafter described.

SUMMARY OF THE PRESENT INVENTION

The present invention discloses a freestanding frame providing means for mounting a garbage bag therein. The freestanding frame has a relatively conic-like shape in cross section with the top orifice smaller than the bottom orifice. Extending between the top and bottom members are a number of struts, which may be telescopic, completing the frame that provides means for removing the frame from a full refuse bag as opposed to lifting the bag from the frame.

Additionally the present invention incorporates means for selectively fastening the plastic bag to or about the top of the frame. In the preferred embodiment, the shape of the rim for the top and bottom is circular, which affords the largest possible area with the least amount of material but does not exclude the use of polygonal shapes.

A primary object of the present invention is to provide a freestanding frame for mounting a plastic bag therein.

Another object of the present invention is to provide a freestanding frame having a conical-like shape is cross section.

Yet another object of the present invention is to provide a freestanding frame having a top opening and a bottom opening with struts extending therebetween.

Still yet another object of the present invention is to provide a freestanding frame wherein said struts can be telescopic.

Another object of the present invention is to provide a freestanding frame wherein said top opening has a smaller orifice than the bottom opening.

Yet another object of the present invention is to provide a freestanding frame wherein the base forms a substantially planar foundation.

Still yet another object of the present invention is to provide a freestanding frame having fasteners for selectively fixing the bag to the frame.

Another object of the present invention is to provide a freestanding frame that can be lifted off of the bag rather than lifting the bag from the frame.

Additional objects of the present invention will appear as the description proceeds.

The present invention overcomes the shortcomings of the prior art by providing a freestanding frame providing means for mounting a garbage bag therein. The freestanding frame has a relatively conic-like shape in cross section with the top orifice smaller than the bottom orifice. Extending between the top and bottom members are a number of struts completing the frame that provides means for removing the frame from a full refuse bag as opposed to lifting the bag from the frame.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
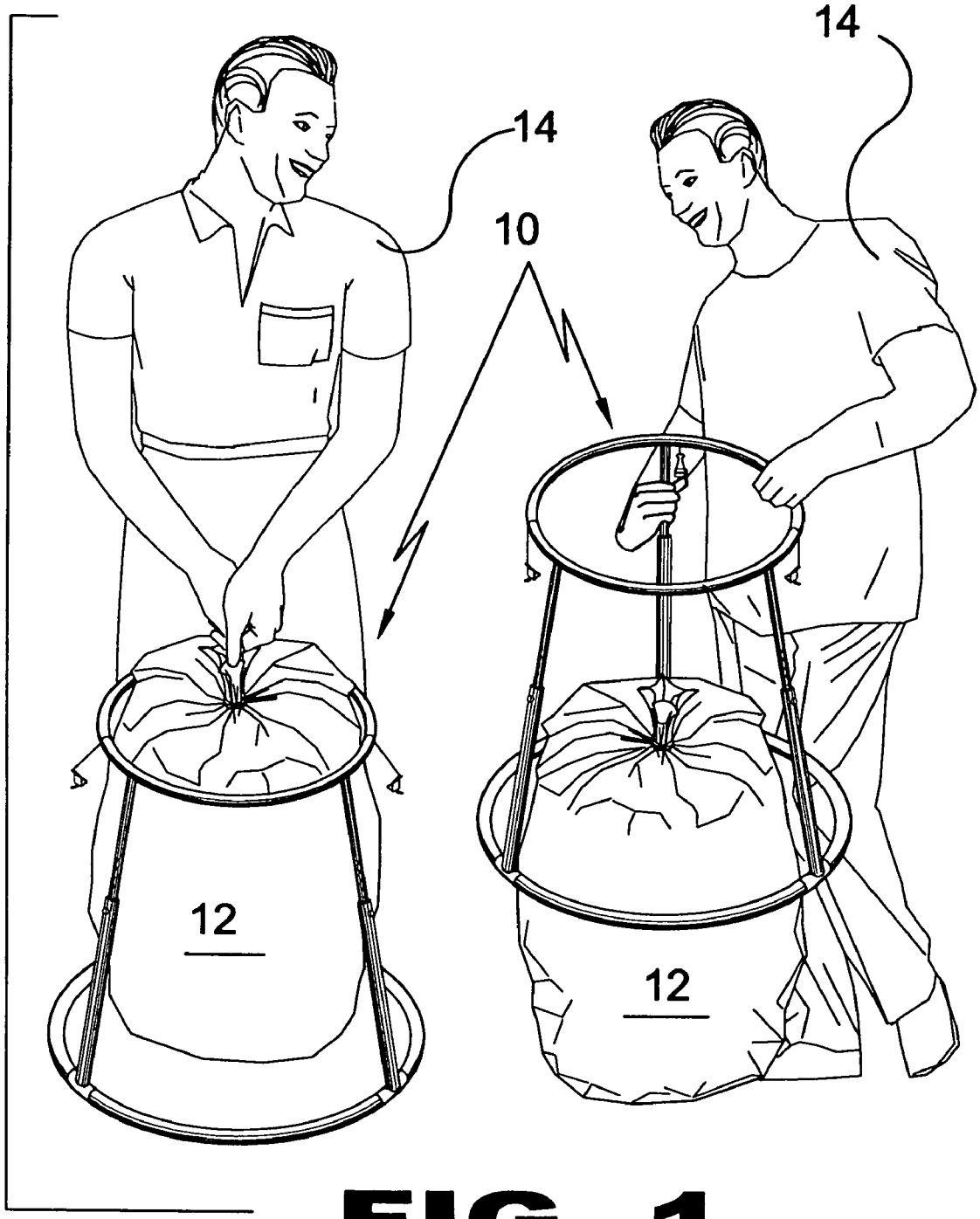
FIG. 1 is an illustrative view of the present invention in use.

With regard to reference numerals used, the following numbering is used throughout the drawings.

10 present invention
12 bag
14 user
16 frame
18 upper ring
20 lower ring
22 leg
24 clip
26 clip types
28 push button retractor
30 trash
32 tie
34 arrow
36 connectors

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turing to FIG. 1, shown therein is an illustrative view of the present invention 10 in use. The present invention 10 discloses a frame to facilitate the holding open of an effectively large plastic trash bag 12 having an upper ring member and lower ring member of a larger radius then the upper ring member, integrally joined by a plurality of retractable rods or legs. A plurality of clip members are fastened to the upper ring for securing a plastic trash bag thereto. The clip members may be of a variety of clip types. The device 10 allows the user 14 to lift its frame up over the filled trash bag 12 as opposed to removing the trash bag from the top.

Figure 2:
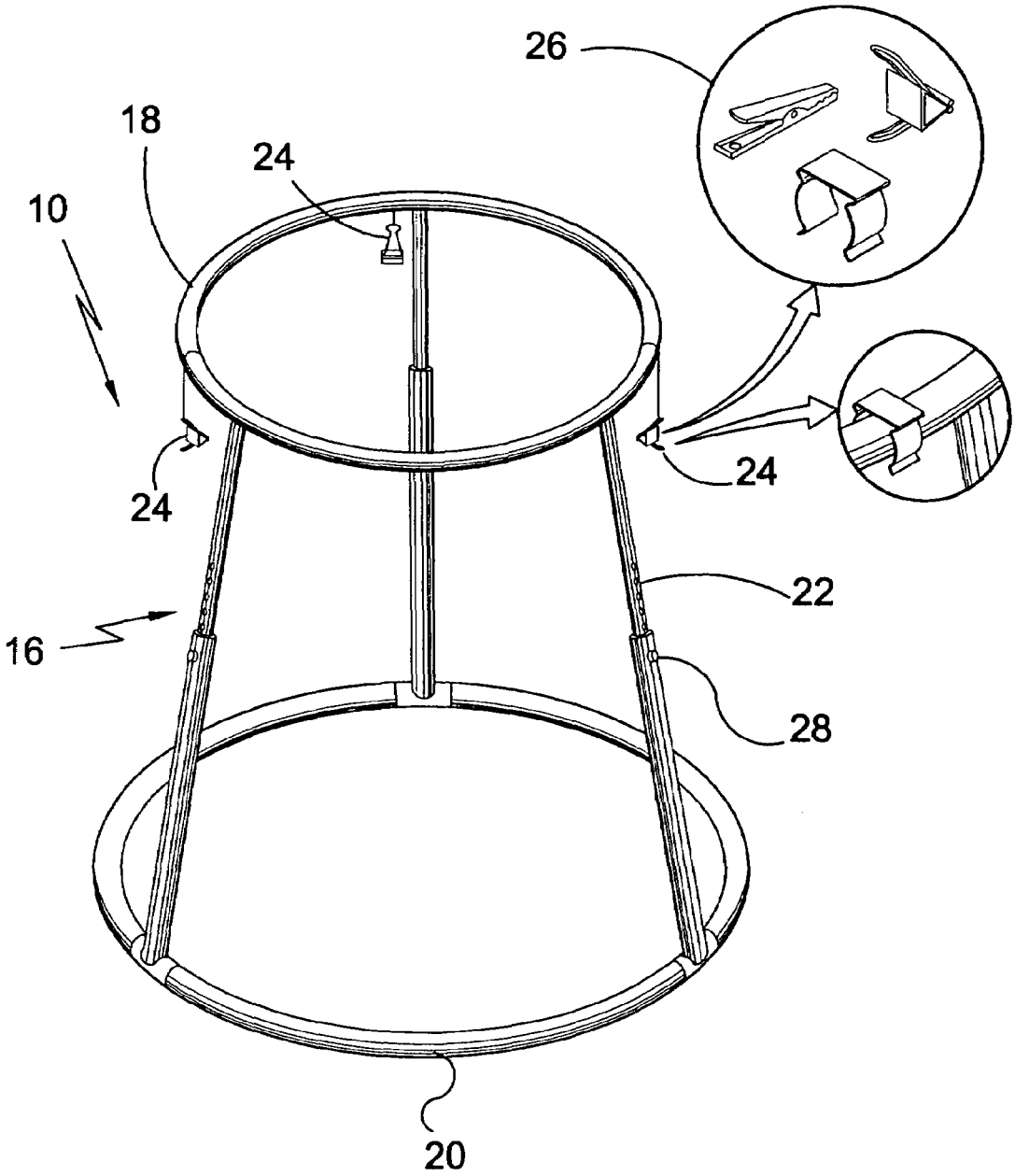
FIG. 2 is a perspective view of the present invention.

Turning to FIG. 2, shown therein is a perspective view of the present invention 10. Shown is the present invention 10 disclosing a frame 16 for the holding open of a plastic trash bag having an upper ring member 18 and lower ring member 20 of a larger radius then the upper ring member. Both ring members 18, 20 are integrally joined by a plurality of retractable rods or legs 22. A plurality of clip members 24 are fastened to the upper ring 18 for securing a plastic trash bag thereto. Also shown are a plurality of clip types 26 and a spring loaded push button retractor 28.

Figure 3:
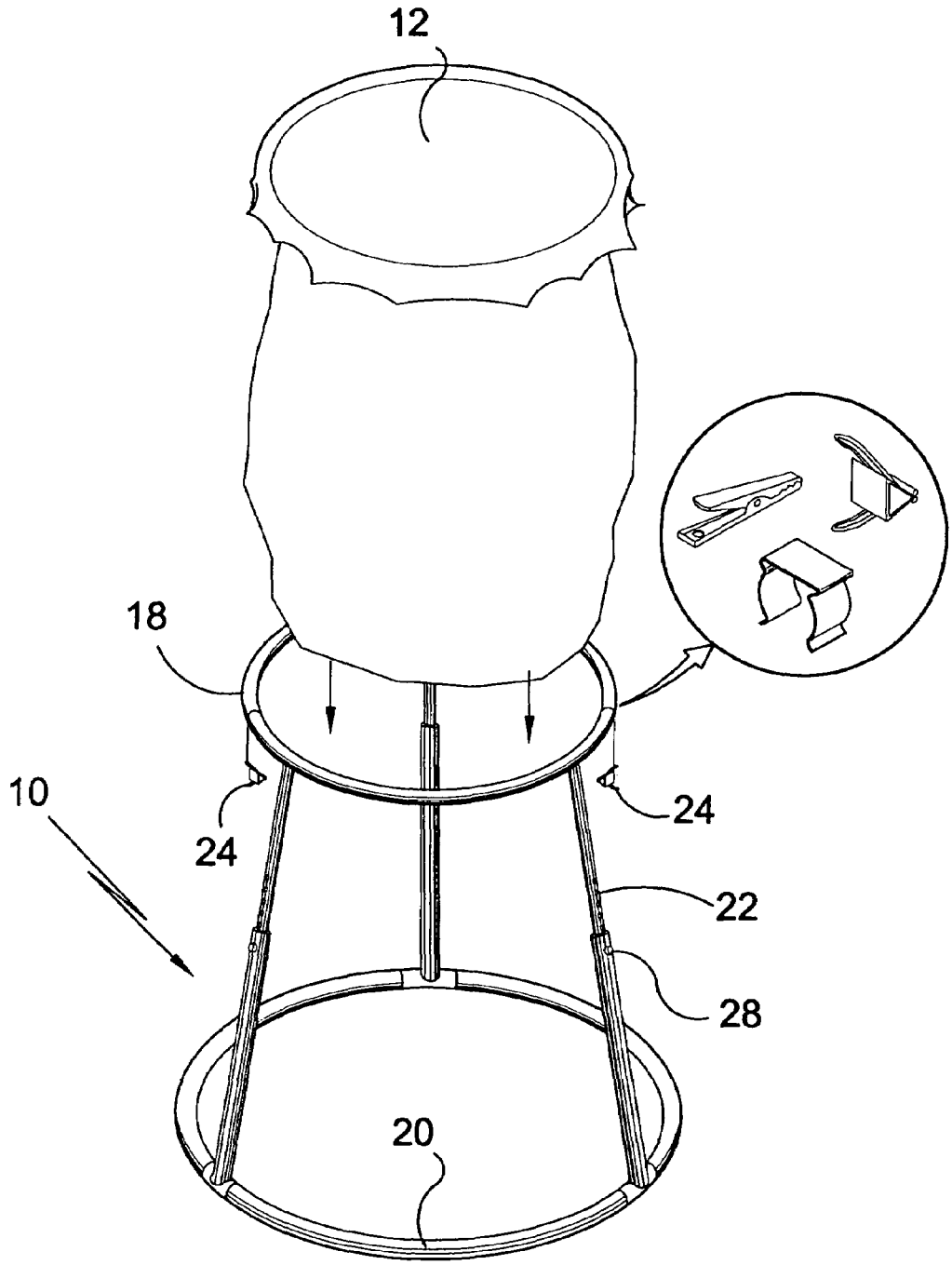
FIG. 3 is a perspective view of the present invention.

Turing to FIG. 3, shown therein is a perspective view of the present invention 10. Shown is the frame of the present invention 10 having a plastic trash bag 12 placed within the upper ring member 18 of the present invention. The lower ring member 20 is of a larger radius then the upper ring member 18. Both ring members 18, 20 are integrally joined by a plurality of retractable rods or legs 22. A plurality of clip members 24 are fastened to the upper ring 18 for securing a plastic trash bag 12 thereto. Retractor 28 is also shown.

Figure 4:
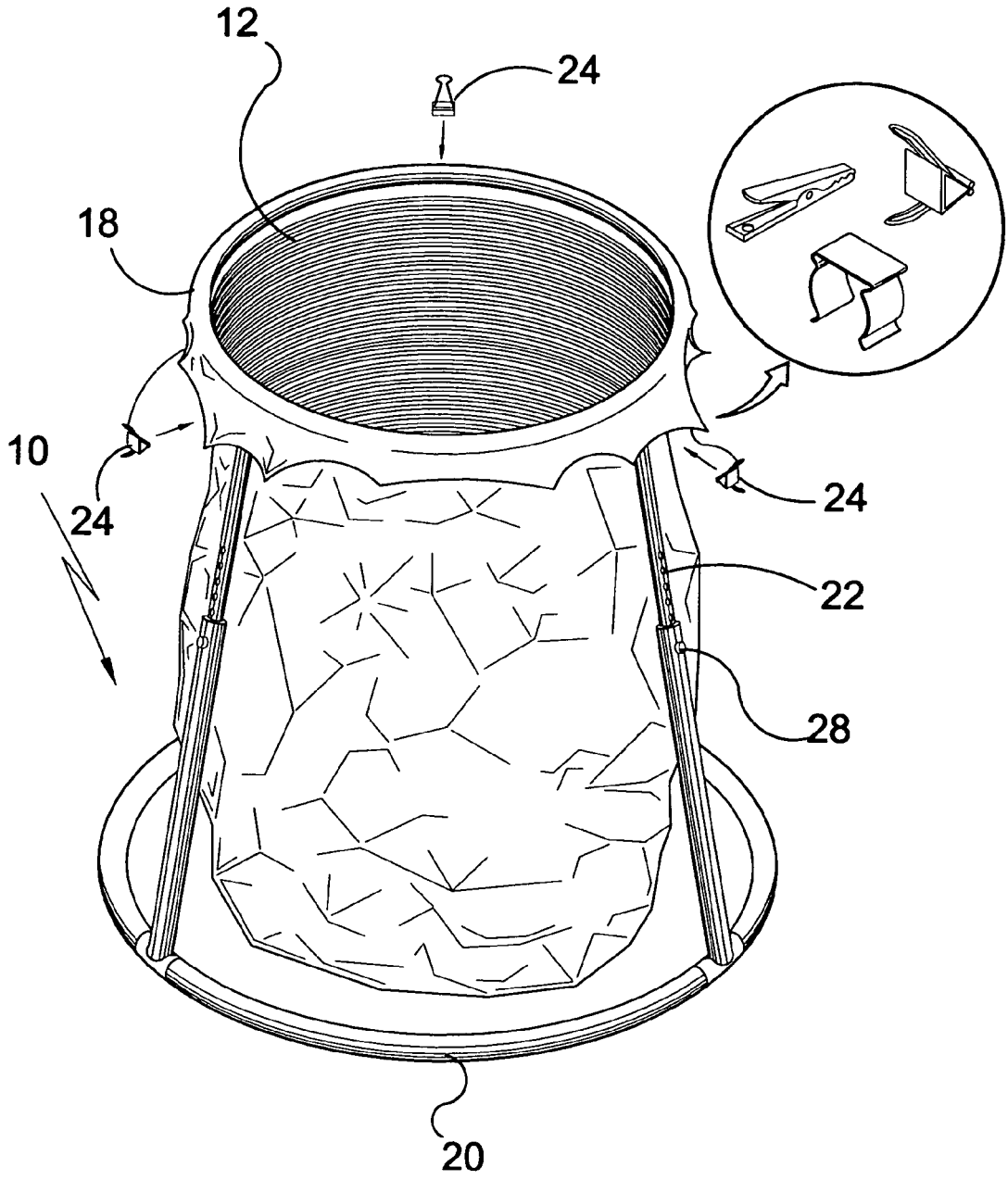
FIG. 4 is a perspective view of the present invention.

Turning to FIG. 4, shown therein is a perspective view of the present invention 10. Shown is the frame of the present invention 10 having a plastic trash bag 12 placed within the frame but not secured with the provided clips 24. The lower ring member 20 is of a larger radius then the upper ring member 18. Both ring members 18, 20 are integrally joined by a plurality of retractable rods or legs 22. A plurality of clip members 24 are fastened to the upper ring for securing a plastic trash bag 12 thereto. Retractor 28 is also shown.

Figure 5:
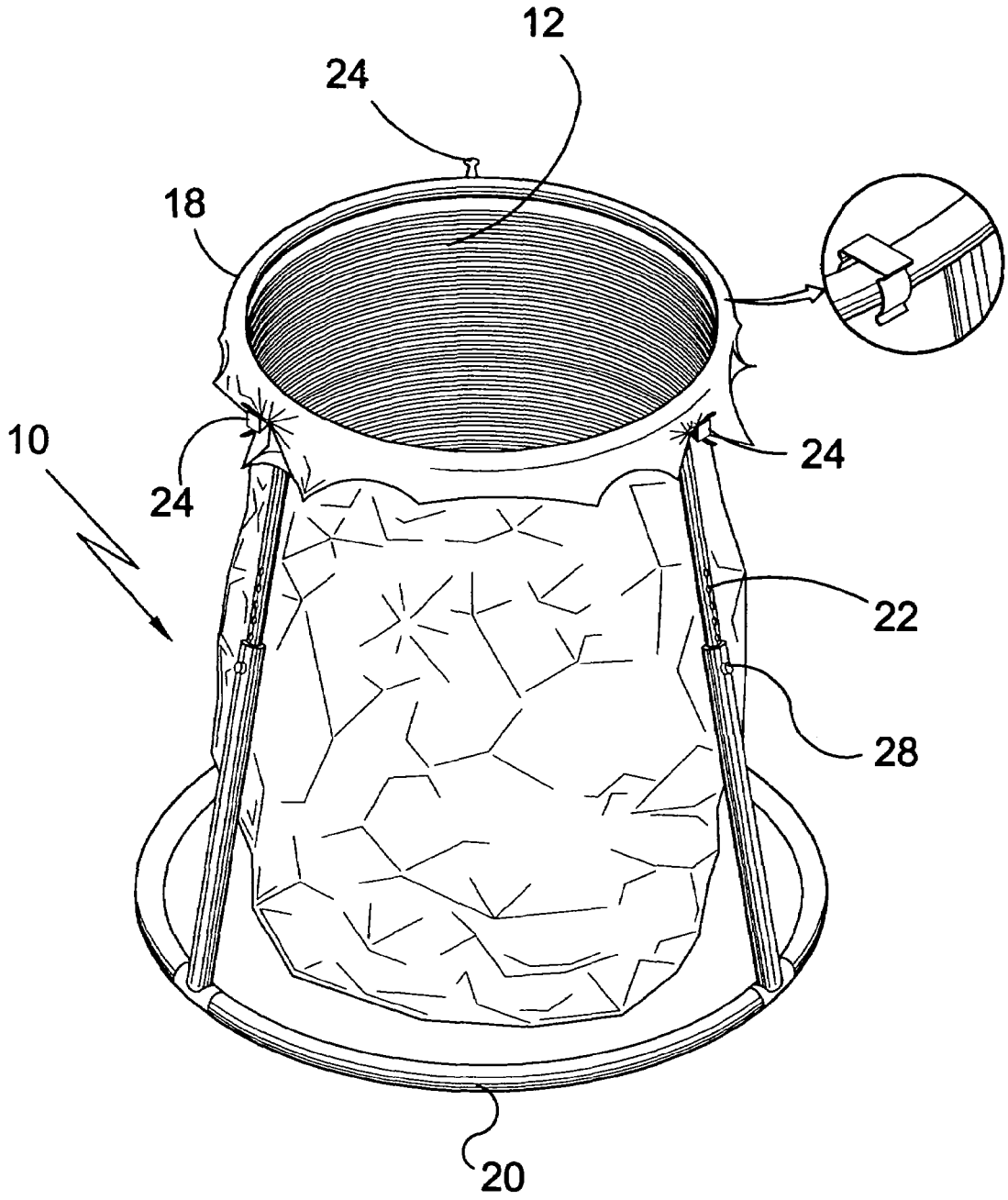
FIG. 5 is a perspective view of the present invention.

Turning to FIG. 5, shown therein is a perspective view of the present invention 10. Shown is the frame of the present invention 10 having a plastic trash bag 12 placed within the frame and secured by the provided clips 24. The lower ring member 20 is of a larger radius then the upper ring member 18. Both ring members 18, 20 are integrally joined by a plurality of retractable rods or legs 22. A plurality of clip members 24 are fastened to the upper ring for securing a plastic trash bag 12 thereto. Retractor 28 is also shown.

Figure 6:
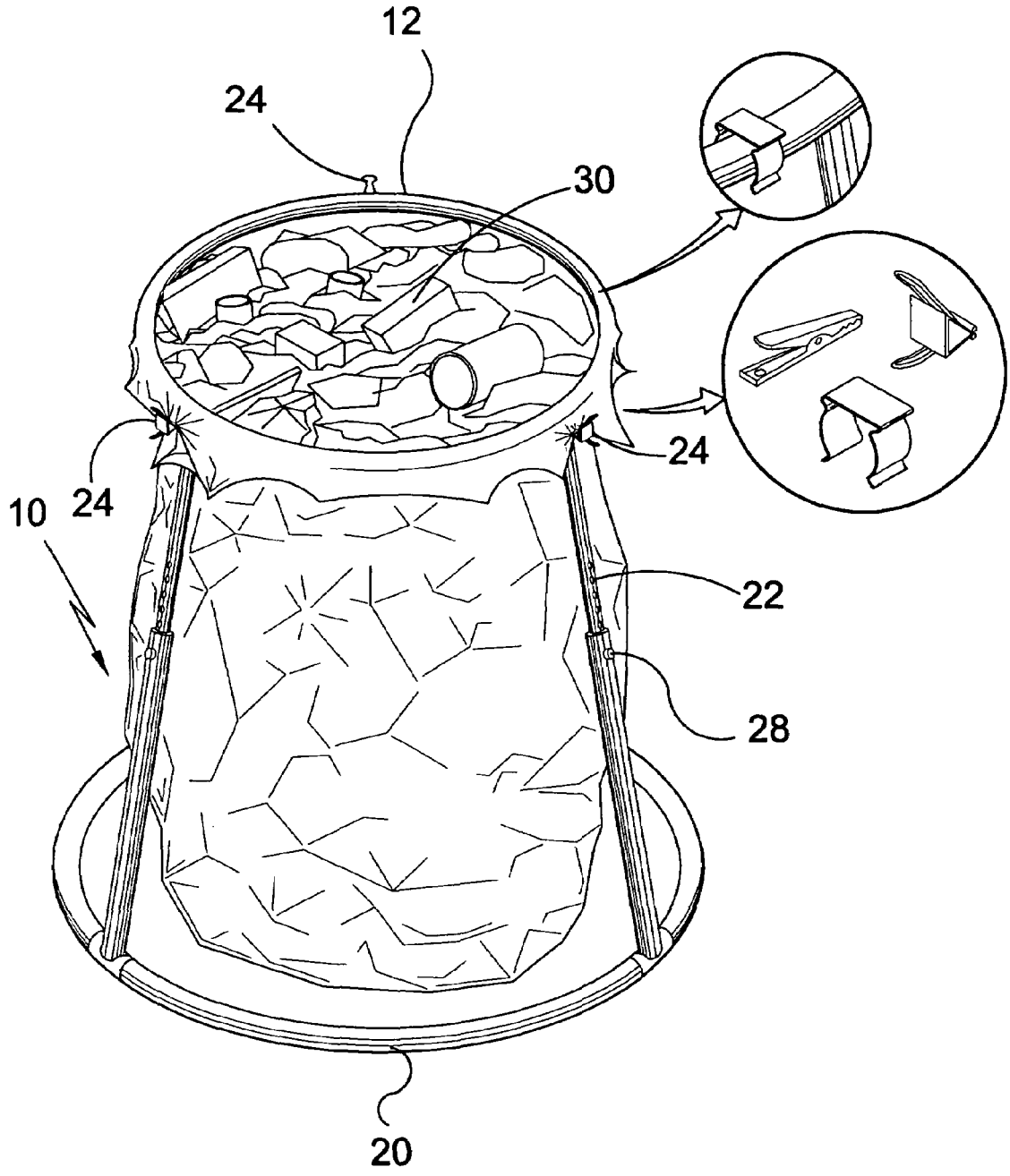
FIG. 6 is a perspective view of the present invention.

Turning to FIG. 6, shown therein is a perspective view of the present invention 10. Shown is the frame of the present invention 10 having a plastic trash bag 12 placed within the frame and secured by the provided clips 24. The trash bag 12 is full to capacity and is ready to be removed. Other previously disclosed elements are also shown along with trash 30.

Figure 7:
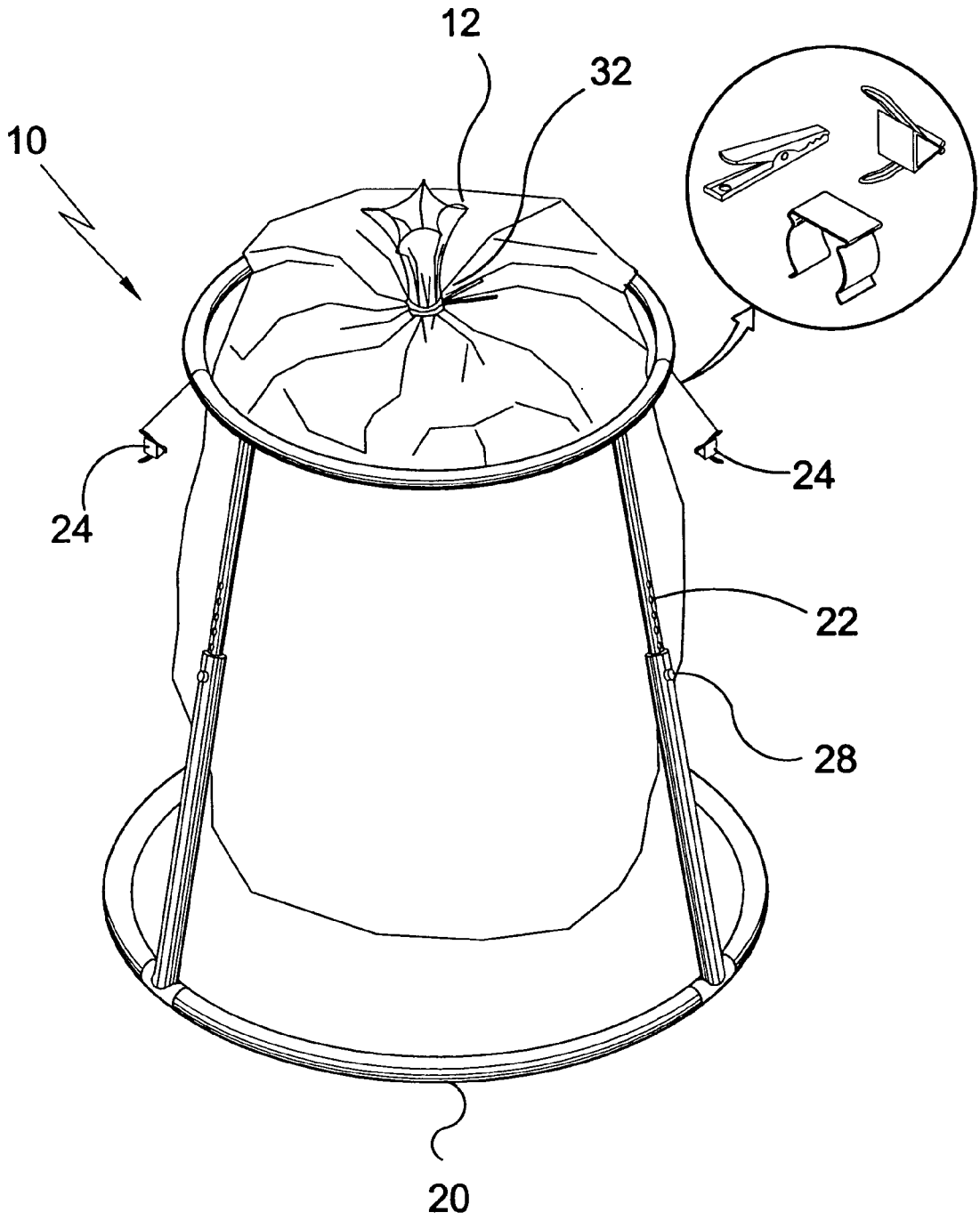
FIG. 7 is a perspective view of the present invention.

Turning to FIG. 7, shown therein is a perspective view of the present invention 10. Shown is the frame of the present invention 10 having a plastic trash bag 12 placed within the frame and tied off with a tie at 32 for removal. The trash bag 12 is full to capacity and is ready to be removed. Other previously disclosed elements are also shown along with trash 30.

Figure 8:
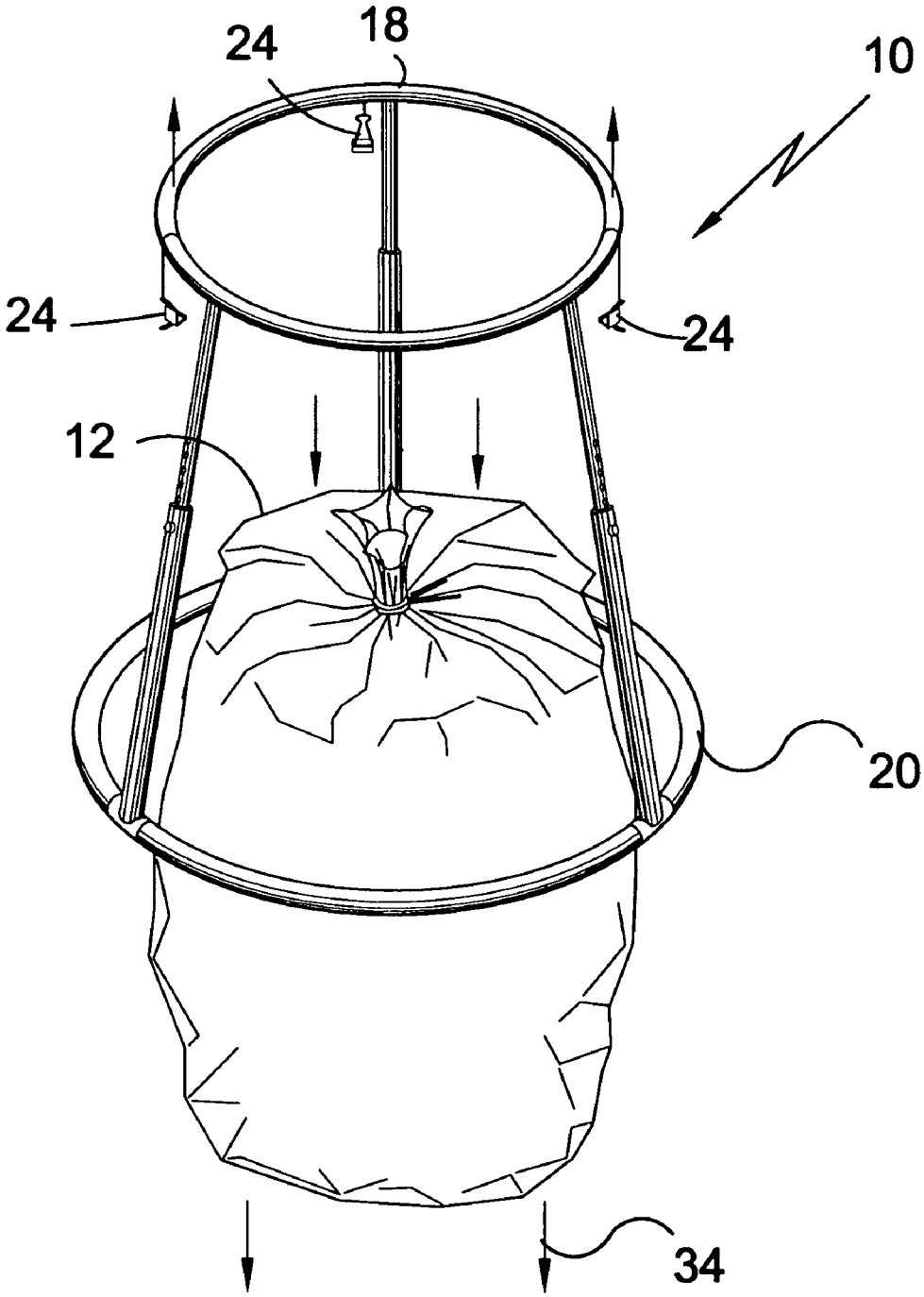
FIG. 8 is a perspective view of the present invention.

Turning to FIG. 8, shown therein is a perspective view of the present invention 10. Shown is the trash bag 12 being removed by arrow 34 through the bottom 20 of the frame of the present invention 10. The frame's function is to facilitate the holding open of a plastic trash bag 12 having an upper ring member 18 and lower ring member 20 of a larger radius then the upper ring member, integrally joined by a plurality of retractable rods or legs. A plurality of clip members 24 are fastened to the upper ring 18 for securing a plastic trash bag 12 thereto.

Figure 9:
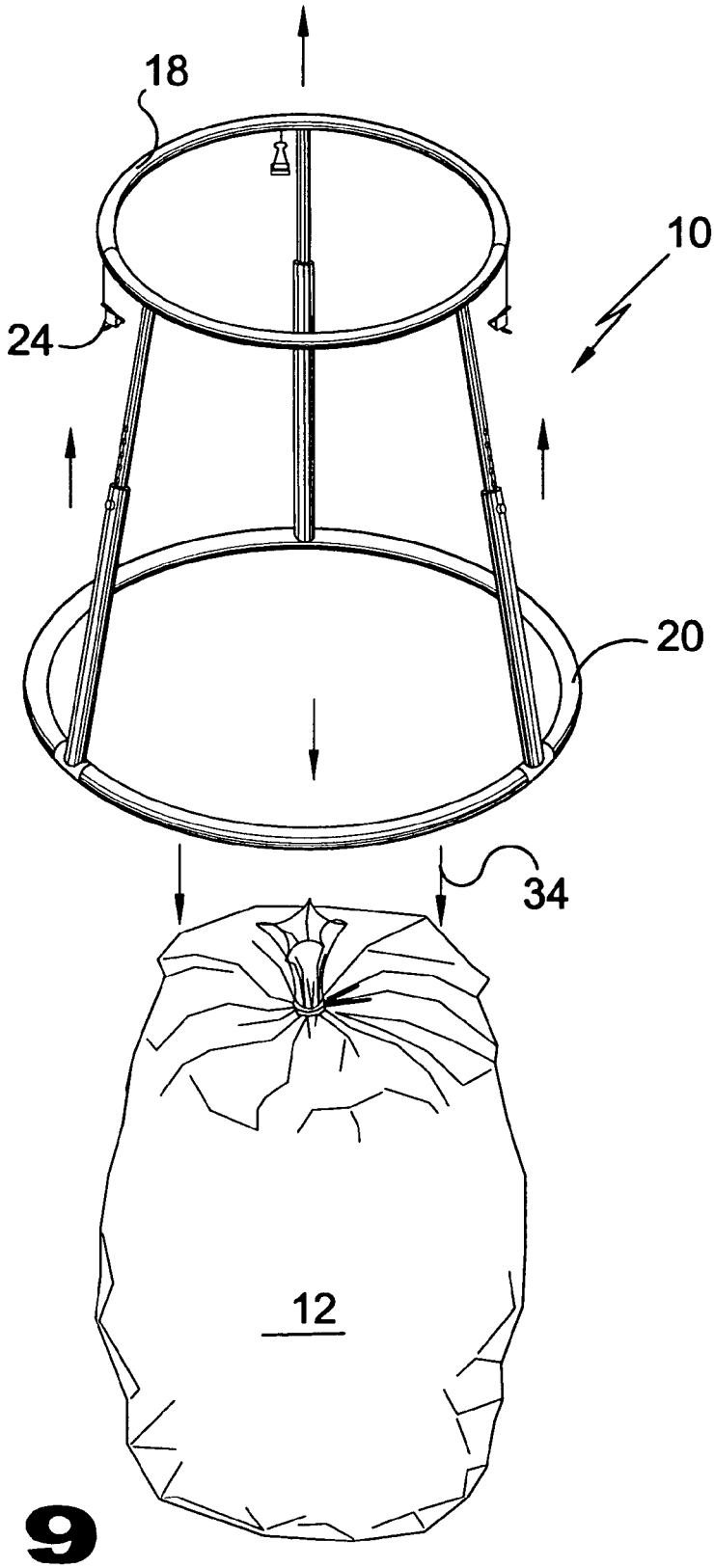
FIG. 9 is a perspective view of the present invention.

Turning to FIG. 9, shown therein is a perspective view of the present invention 10. Shown is the trash bag 12 being removed by arrow 34 through the bottom 20 of the frame of the present invention 10. The frame's function is to facilitate the holding open of a plastic trash bag 12 having an upper ring member 18 and lower ring member 20 of a larger radius then the upper ring member, integrally joined by a plurality of retractable rods or legs. A plurality of clip members 24 are fastened to the upper ring 18 for securing a plastic trash bag 12 thereto.

Figure 10:
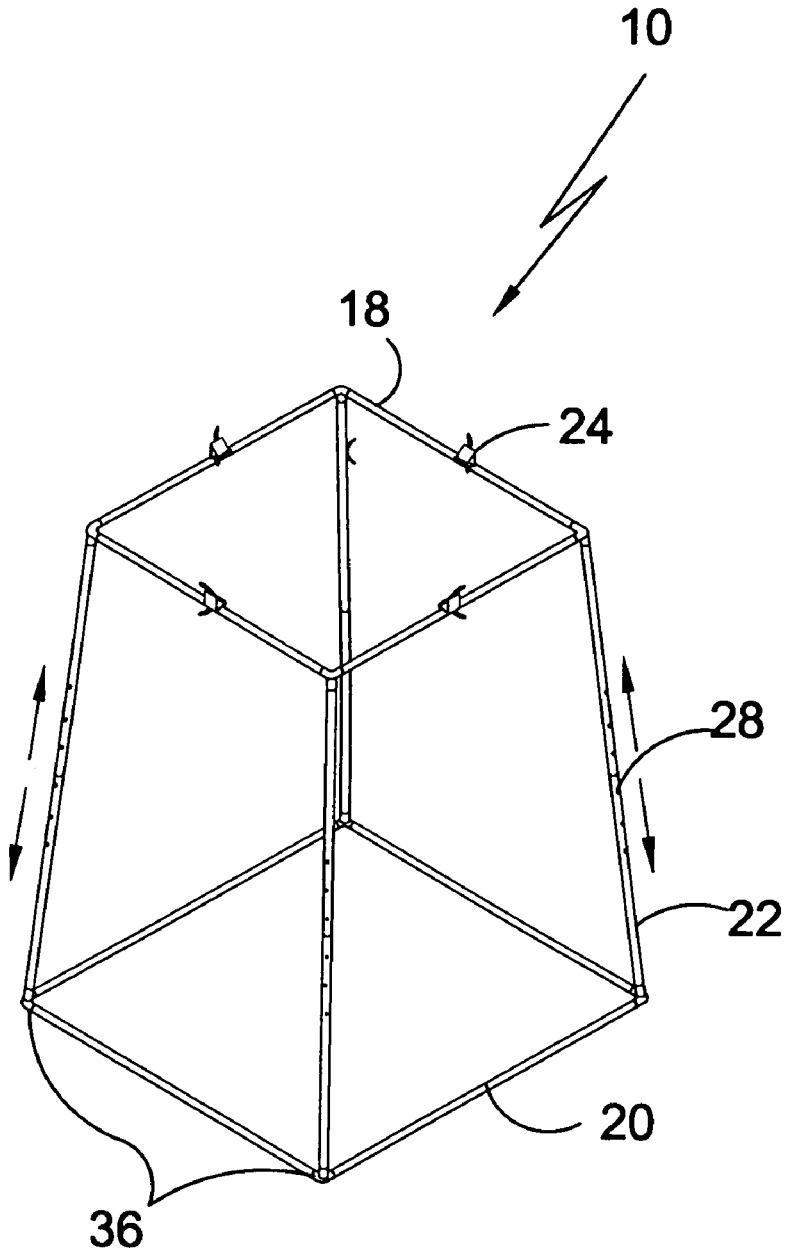
FIG. 10 is a perspective view of the rectangular shaped frame of the present invention.

Turning to FIG. 10, shown therein is a perspective view of the rectangular shaped frame of the present invention 10. Shown is the rectangular shaped frame of the present invention 10. The frame's function is to facilitate the holding open of a plastic trash bag having an upper ring member 18 and lower ring member 20 of a larger radius then the upper ring member, integrally joined by a plurality of retractable rods or legs 22. A plurality of clip members 24 are fastened to the upper ring 18 for securing a plastic trash bag 12 thereto. Connectors 36 are used to join individual frame members. Push button 28 is also shown.

Figure 11:
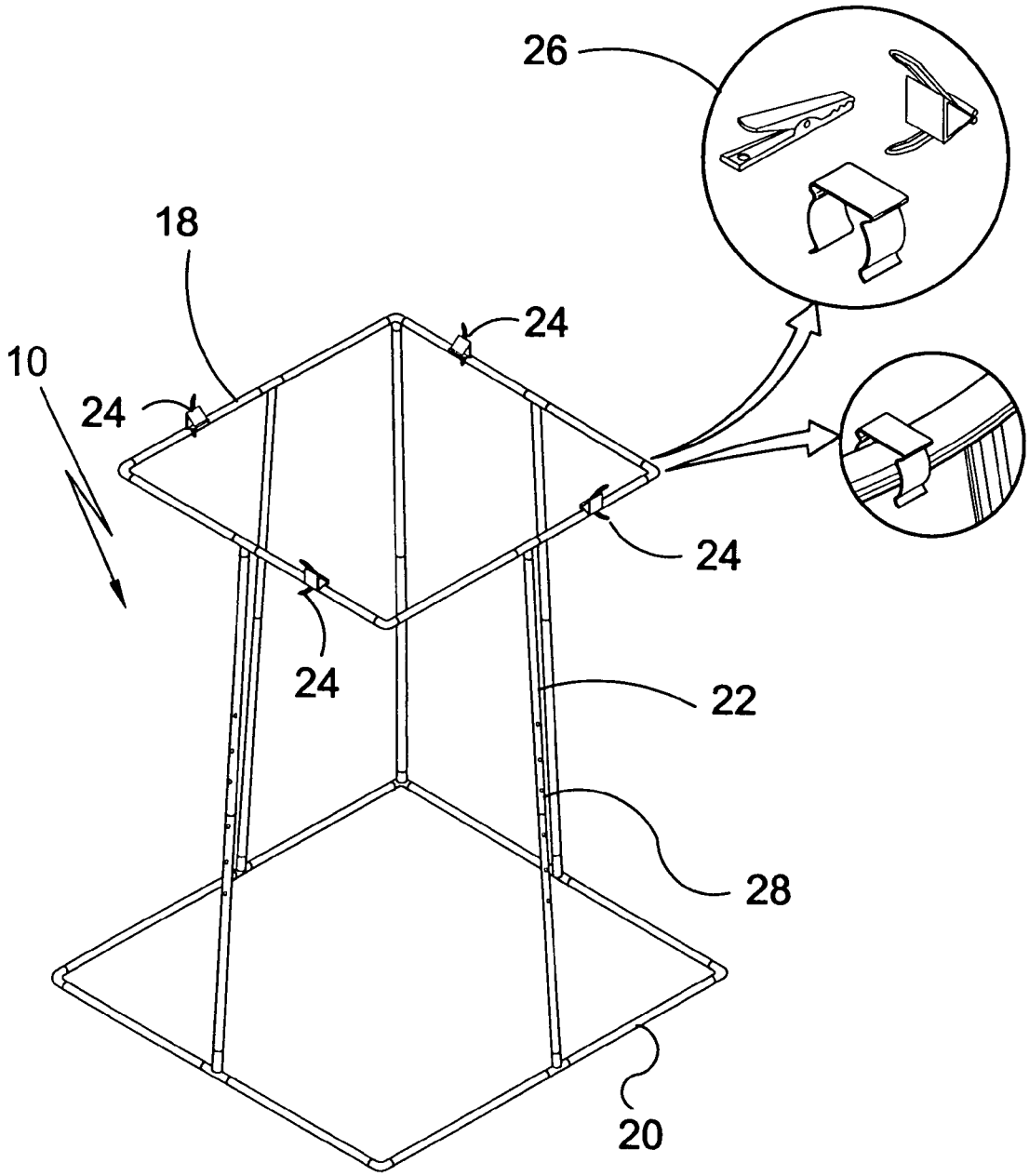
FIG. 11 is a perspective view of another rectangular shaped frame of the present invention.

Turning to FIG. 11, shown therein is a perspective view of another rectangular shaped frame of the present invention 10. Shown is the rectangular shaped frame of the present invention 10. The frame's function is to facilitate the holding open of a plastic trash bag having an upper frame member 18 and lower frame member 20 of a larger size then the upper frame member, integrally joined by a plurality of retractable rods or legs 22 connecting midpoints of the sides of the upper frame to midpoints of corresponding sides of the lower frame. A plurality of clip members 24 are welded to the upper frame for securing a plastic trash bag thereto. Other previously disclosed elements are also shown.

The fifth leg joining one corner of each of the upper frame member 18 to the lower frame member 20, as illustrated in FIG. 11, provides greater stability and rigidity to the present invention 10.

Figure 12:
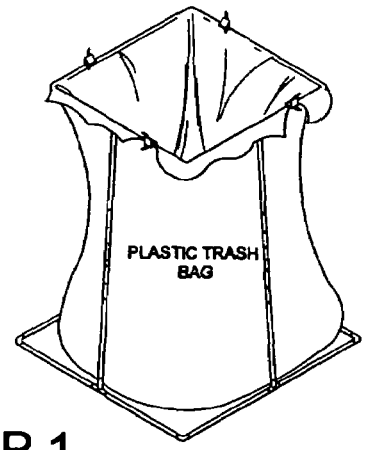
FIG. 12 is an illustrative view of assembly steps of the present invention.
Figure 12:
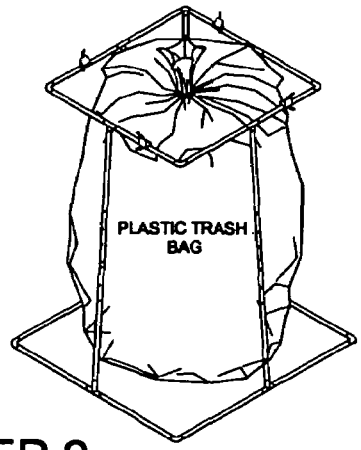
Figure 12:
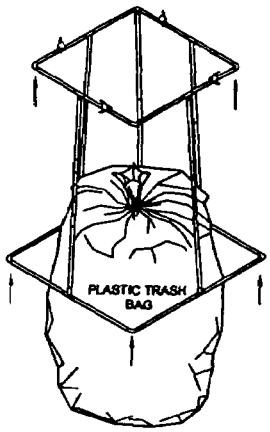
Figure 12:
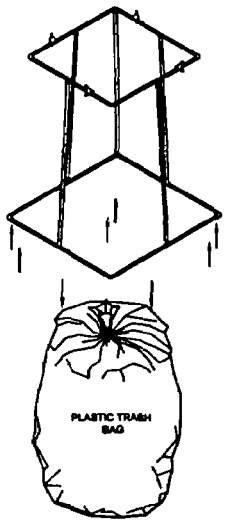

Turning to FIG. 12, shown therein is an illustrative view of assembly steps of the present invention. Shown is an illustrative view of the steps required to mount a garbage bag to the frame of the present invention. The frame's function is to facilitate the holding open of a plastic trash bag having an upper frame member and lower frame member of a larger size then the upper frame member, integrally joined by a plurality of retractable rods or legs. A plurality of clip members are welded to the upper frame for securing a plastic trash bag thereto. The operational steps of the present invention follow: 1) install empty bag, fasten open top of bag using retaining clips and bag is ready to use; 2) when bag is full remove the retaining clips, tie closed the top of the bag with a bag tie; and, 3) to remove bag; lift frame up over full garbage bag wherein garbage bag remains resting on ground.

I claim:

1. An apparatus for holding a bag, comprising:

a) a first upper rectangular shaped frame member, disposed in substantially a horizontal plane, b) a second lower rectangular shaped ground-engaging frame member having sides longer than corresponding sides of said first upper frame member, c) a plurality of legs connecting said first frame member to said second frame member comprising four legs connecting midpoints of the sides of said upper frame member to midpoints of corresponding sides of said lower frame member, respectively, and a fifth leg connecting a corner of said upper frame with a corresponding corner of said lower frame member; and, d) means for attaching an open end of a bag around said upper frame member so that said bag is held inside said frame members with the open end of the bag being upwardly disposed for receiving trash therein whereby a bag can be placed on the ground in said frame members and filled with trash, and said frame members can be removed from the bag by a user lifting said frame members off the bag.

2. The apparatus of claim 1, wherein each of ad legs are telescoping legs.

3. The apparatus of claim 2, further comprising a push button retractor being disposed on each said leg for use in adjusting the length of said leg.

4. The apparatus of claim 3, wherein each said leg comprises a male portion and a female portion, said male and female portion having a plurality of longitudinally spaced apart holes therein, wherein said holes on said male and female portions are co-aligned, a push button retractor being disposed on said female portion so that said retractor can be extended through said male and female portions for use in adjusting the length of said leg.

5. The apparatus of claim 4, wherein said means for attaching comprises a clip.

6. The apparatus of claim 4, wherein said means for attaching comprises an alligator clip.

7. The apparatus of claim 4, wherein said means for attaching comprises a clip having a pair of opposing resilient members wherein said members are biased toward each other.

* * * * *